US005795444A

United States Patent [19]

Rendall et al.

[11] Patent Number: 5,795,444

[45] Date of Patent: Aug. 18, 1998

[54] METHOD AND APPARATUS FOR REMOVING BITUMINOUS OIL FROM OIL SANDS WITHOUT SOLVENT

[75] Inventors: John S. Rendall; Stephen J. Lane, both of Albuquerque, N. Mex.

[73] Assignee: Solv-Ex Corporation, Albuquerque, N. Mex.

[21] Appl. No.: 356,148

[22] Filed: Dec. 15, 1994

[51] Int. Cl.[6] ..... C10C 1/20

[52] U.S. Cl. ..... 196/46.1; 208/390; 208/391

[58] Field of Search ..... 196/461.1; 210/84; 208/391

[56] References Cited

U.S. PATENT DOCUMENTS

| | | | |
|---|---|---|---|
| 3,656,938 | 4/1972 | Penzes | 208/11 |
| 3,971,718 | 7/1976 | Reid | 210/84 |
| 4,136,014 | 1/1979 | Verneulon | 208/11 |
| 4,424,112 | 1/1984 | Rendall | 208/11 LE |
| 4,533,459 | 8/1985 | Denle | 208/11 |
| 4,818,373 | 4/1989 | Barholic | 208/11 |
| 4,875,998 | 10/1989 | Rendall | 208/390 |
| 4,946,597 | 8/1990 | Sury | 208/11 |
| 4,966,687 | 10/1990 | Hall et al. | 208/11 |
| 5,124,008 | 6/1992 | Rendall et al. | 204/61 |
| 5,192,423 | 3/1993 | Duczmal | 208/11 |

FOREIGN PATENT DOCUMENTS

| | | |
|---|---|---|
| 667712 | 7/1963 | Canada . |
| 770860 | 3/1957 | United Kingdom . |

*Primary Examiner*—Helane Myers
*Attorney, Agent, or Firm*—Thomas E. Schatzel; Law Offices of Thomas E. Schatzel, A Prof. Corporation

[57] ABSTRACT

A system and method for immediately separating oil sands into three layers uses a logwasher with paddles that mixes the oil sands with hot water and steam. The three layers of bitumen, clay/sand/water slurry and rock separate effectively and immediately and are not re-mixed in further processing as was conventional, further producing a clay fraction from the fines for mineral processing.

5 Claims, 3 Drawing Sheets

METHOD AND APPARATUS FOR REMOVING BITUMINOUS OIL FROM OIL SANDS WITHOUT SOLVENT

RELATED PATENTS

One of the present inventors, John S. Rendall is an inventor named in three previously issued patents: U.S. Pat. No. 4,424,112, issued Jan. 3, 1984, U.S. Pat. No. 4,875,998, issued Oct. 24, 1989, and U.S. Pat. No. 5,124,008, issued Jun. 23, 1992, all of which are incorporated herein by reference.

BACKGROUND OF THE INVENTION

1. Field of the Invention

The invention relates generally to mining and specifically to the removal of bitumen from rocks, sands and clay.

2. Description of the Prior Art

Vast deposits of oil exist throughout the world, and especially in Canada, as thick, heavy oil, in the form of bitumen mixed with solid minerals and water. The tar sands that hold the bitumen contain rich amounts of valuable minerals, especially alumina, in the sand itself. The sands include a fines fraction, defined as particles less than forty-four microns, that have a clay component (0–2 microns) and a silica fine sand component (2–44 microns). High bitumen content in the tar sand is usually associated with a low fines fraction. Conversely, a low bitumen content in the tar sand is usually associated with a high fines content.

Typically in the fines fraction there are found two parts silica fine sand component to one part clay component, e.g., one-third is clay. About 35% of such clay is alumina. Certain low grade ores, conventionally comprised of undifferentiated silica fine sand and clay, have as little as 6% alumina in the fines fraction. Such fines fractions are a problem when used in exothermic reactions that separate out the alumina. Fines fractions, with more than 10% alumina, are much more easily processed with exothermic reactions. Therefore, it is desirable to have a bitumen separation process that can produce tar sands clays separated from fine sand.

John S. Rendall, the present inventor, describes in U.S. Pat. No. 4,424,112, issued Jan. 3, 1984, a method and apparatus for solvent extraction of bitumen oils from tar sands and their separation into synthetic crude oil and synthetic fuel oil. Tar sands are mixed with hot water and a solvent to form a slurry while excluding substantially all air. The slurry thus contains sand, clay, bitumen oils, solvent and water. This slurry is separated into bitumen extract, which includes bitumen oils, solvent and water, and a solids extract containing sand, clay, solvent and water. The bitumen extract is processed to selectively remove the water and fines. The bitumen extract is then processed to remove the solvent for recycle, and the bitumen as crude oil. Water is separated from the bitumen and solid extracts and is also reused.

A hot water bitumen extraction process is described by John S. Rendall in U.S. Pat. No. 4,875,998, issued Oct. 24, 1989. Crushed tar sands are conditioned in hot water while excluding air. Oversized and inert rocks are removed by screening. A water immiscible hydrocarbon solvent is used to extract the bitumen content to form a bitumen extract phase, a middle water phase, and a lower spent solids phase, each of which are processed for bitumen oils and to recover solvent and water for reuse.

A method of extracting valuable minerals and precious metals from oil sands ore bodies is described by John S. Rendall and Valentine W. Vaughn, Jr., in U.S. Pat. No. 5,124,008, issued Jun. 23, 1992. Both coarse and fine sand fractions are produced after extracting the hydrocarbons, and both fractions contain valuable minerals and precious metals. These fractions are agglomerated with concentrated sulfuric acid and leached. The sulfuric acid mother leach liquor is processed to remove sulfate crystals of aluminum, iron and titanyl, while recycling the raffinate. The aluminum sulfate crystals are converted to cell-grade alumina product.

Conventional methods and processes use solvents that are expensive and can pollute the environment as a consequence of bitumen extraction from tar sands. The clays in the tar sands are a valuable source of fine particle alumina, and more efficient methods and processes to separate bitumen and alumina are needed.

SUMMARY OF THE PRESENT INVENTION

It is therefore an object of the present invention to provide a process for the efficient removal of bitumen from oil sands without the necessity of using a solvent.

It is a further object of the present invention to provide a tar sands processing system that separates out the clay fraction for efficient exothermic alumina extraction.

It is another object of the present invention to provide a process that cleans bitumen from oil sands sufficient to allow aluminum refining of the remaining aluminum ore in the clean oil sands.

It is a further object of the present invention to provide a processing system that produces a minimum of hazardous waste products in the production of oil and aluminum from bituminous oil sands.

Briefly, in a preferred embodiment, an extracting system comprises a logwasher that receives oil sands from a mine and hot recycle water. A slit and a surface dam are provided in the logwasher to draw off bitumen from the surface in a first flow. A rock and sand wash flows under the dam in a second flow. "Thermal shock" heat is applied to the logwasher to stimulate the separation of the bitumen from the water. The rapid heat rise causes gas intrinsic in the bitumen to expand on release and thus lower the specific gravity of the bitumen. The rapid application of heat in the logwasher and the early separation of the bitumen occur before the bitumen fully outgases. However, other devices such as hydrocyclones may be used to achieve this result.

An advantage of the present invention is that a system is provided that produces substantially cleaner rocks and sand, free of bitumen, and thus yields more bitumen oils from a given amount of tar sand.

A further advantage of the present invention is that a system is provided that produces low levels of hazardous waste products.

Another advantage of the present invention is that a method is provided for cleaning oil sands of bitumen and thus being able to return very clean sand backfill to the mine.

Another advantage of the present invention is that a system is provided that recycles substantial amounts of hot water.

These and other objects and advantages of the present invention will no doubt become obvious to those of ordinary skill in the art after having read the following detailed description of the preferred embodiment that is illustrated in the various drawing figures.

DETAILED DESCRIPTION OF THE PREFERRED EMBODIMENTS

Figure 1:
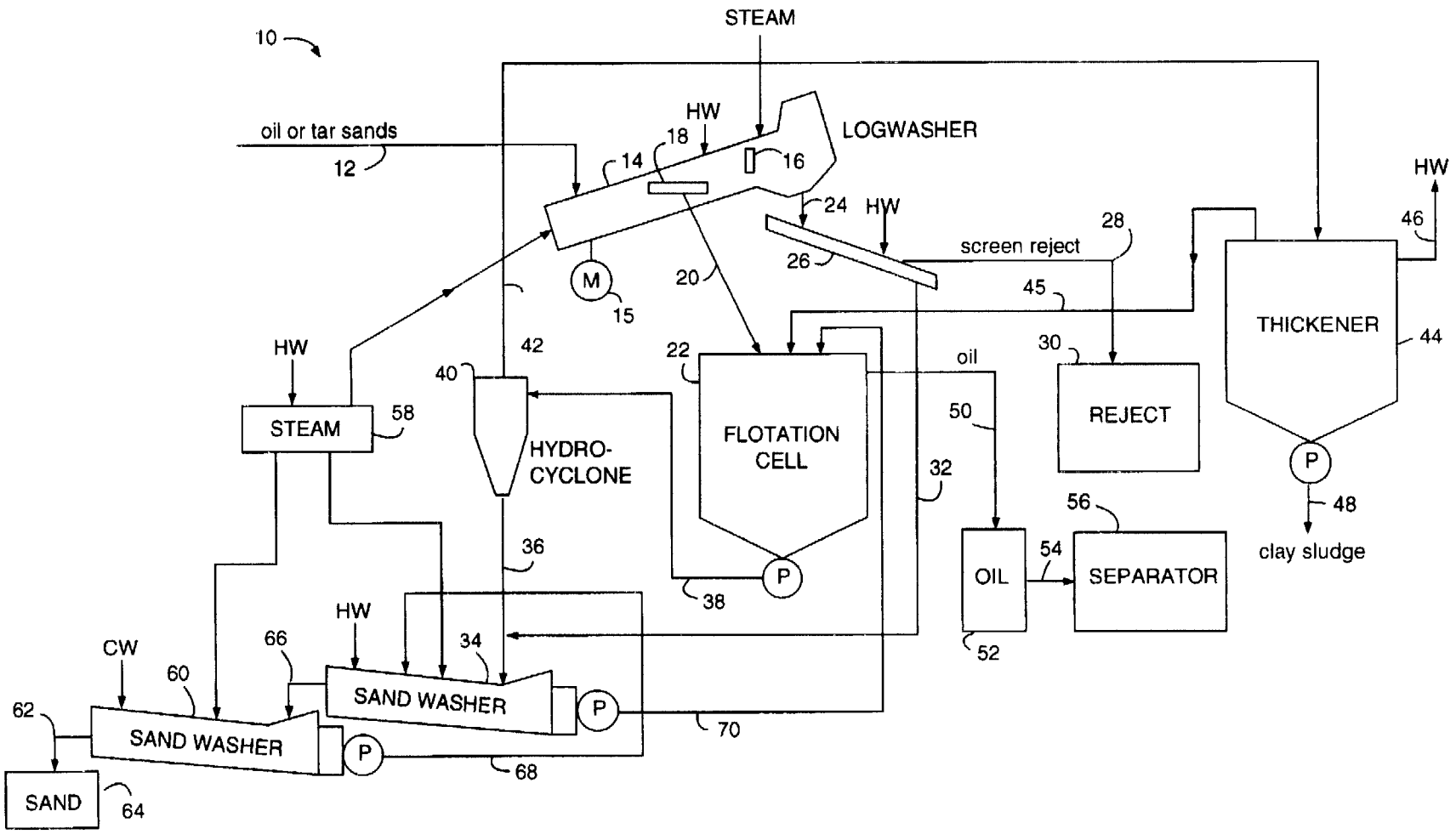
FIG. 1 is a block diagram of a system for removing clay and bitumen oils from tar sands in a first embodiment of the present invention with an inclined logwasher and two sand washers in series.

FIG. 1 illustrates a system for removing clay and bitumen oils from tar sands in a first embodiment of the present invention referred to herein by the general reference number 10. The system 10 accepts an input 12 of oil or tar sands from a mine and/or crusher to a logwasher 14 on an incline. A motor 15 changes the incline of the logwasher 14 from level, and can be attached to manipulate either end of the logwasher 14. The optimum incline angle varies with different types of oil sands. The angle of the surface of a slurry within the logwasher 14 with respect to the longitudinal length and axis of rotation of the logwasher 14 is what is actually affected by the motor 15. Rotating paddles within the logwasher 14 agitate the tar sands with injected hot water (HW) and steam. The separation of hydrocarbons from the tar sands is immediate, probably as a result of ancient gas entrained in the hydrocarbons that causes the hydrocarbons, e.g., bitumen, to float to the surface of the water in the logwasher 14. Artisans have conventionally supposed that air had to be mixed in to effectuate separation by flotation, since pure bitumen has a specific gravity akin to that of pure water. Such conventional mixing-in of air complicates and makes the separation out of bitumen, by any means, more difficult.

Artisans understand the sands are protected by an envelope of water, which, in turn, is enveloped in bitumen. Re-mixing the sands, once separated, will coat the bitumen on the sand and bind the water, clay and bitumen, thus increasing the energy required to once again separate them. Conventional processes pass all the separated outputs of their logwashers, tumblers or other similar units, through a screen and into a flotation vessel. It is highly beneficial with the present invention not to re-mix the bitumen oils with the sand/clay/water slurry and/or rocks once they are separated by the logwasher 14.

A baffle 16 and a horizontal side slit 18 draw off and skim separated hydrocarbons in a flow 20 and chute them down into a flotation cell 22, which acts to separate the constituents by flotation in water. The baffle 16 is positioned at the oil and water interface so that sand and rock with water can pass underneath and oil is dammed up behind it. The baffle 16 increases the oil layer thickness to improve the skimming action of the slit 18. In order to maintain their effectiveness in skimming bitumen, the position and the angle of the baffle 16 and slit 18 should preferably be relatively adjusted to compensate for any changes in inclination caused by motor 15 to the logwasher 14. Alternatively, the slit 18 can be positioned on either side of logwasher 14 which is then positioned directly over the flotation cell 22 to minimize the distance the bitumen froth in the flow 20 has to travel. A sand/clay/water slurry covered with a floating oil layer of six to twelve inches is preferably maintained within the flotation cell 22. Such an oil mass on the slurry surface is maintained to collect particles of oils that separate from the sand/clay/water slurry in the flow 20.

A logwasher slurry 24 of sand, clay, rocks and water is passed through a two-deck screen 26 that is washed by hot water. A first three-eighths inch screen is followed by a quarter inch screen in the two-deck screen 26 to screen out the rocks. Other screen sizes may be used for particular applications where the sand washer gap allows larger particles to pass upwards without binding the material transport screw mechanism associated with conventional sand washers. A flow of rejected rocks 28, e.g., larger than the minimum screen size, is deposited in a reject bin 30. A flow of sand, clay and water in a slurry 32 is fed to a first sand washer 34. The underflow from the flotation cell 22 is pumped through a slurry feed 38 into a hydrocyclone system 40 which may comprise one or more stages of hydrocyclones. A typical hydrocyclone is described by Charles M. Reid, in U.S. Pat. No. 3,971,718, issued Jul. 27, 1976. The underflow 36 comprises substantially no clay or bitumen. Although hydrocyclones have been conventionally used in tar sands processing, the way hydrocyclone system 40 is used in the system 10 is unique. The flotation cell 22 adds some more heat, and pumps a hydrocyclone slurry feed 38 to the hydrocyclone system 40. According to one theory, some bitumen is occluded in the slurry feed 38, e.g., as a result of the rapid fall of sand at the water and oil interface within the flotation cell 22 which traps some oil as it falls. There will always be some bitumen associated with the water, which is washed out by the wash water in the sand washers.

A screen reject is not necessary if a sand washer is used with a screw clearance on its base that allows for rocks. A crusher which feeds rocks to the logwasher that are reduced to under three inches would be desirable in such a case.

The hydrocyclone system 40 spins clay, bitumen and water out of the sand by centrifugal force and produces an overflow 42. Two or more hydrocyclone units within the hydrocyclone system 40 are used to further remove silica silt from the clay fraction. The overflow 42 goes directly to a standard thickener 44 for oil skimming, clay sludge thickening and clean water recovery. An oil overflow 45 is returned to the flotation cell 22. A water overflow 46 provides recovered hot water (HW) to the rest of the system. A densified sludge under-flow 48 is pumped out. An overflow 50 fills an oil tank 52 which has a flow 54 into a froth tank 56. Steam is provided by a steam unit from hot water to the logwasher 14, the first sand washer 34 and a second sand washer 60. A clean sand flow 62 is collected in a sand bin 64 and contains about 25% water. Such water accounts for the majority of water lost in the system 10, and must be balanced by make-up water. An intermediate sand flow 66 is output from the first sand washer 34 to the second sand washer 60. Make-up water for water lost in system 10 can be introduced as cold water (CW) to the second sand washer 60. This would then act as a heat-recovery mechanism in that the sand output flow 62 gives-up heat to a sand-heated wash-water return flow 68 that is pumped from the second sand washer 60 to the first sand washer 34. Similarly, a water, clay and bitumen flow 70 is returned from the first sand washer 34 to the flotation cell 22.

In operation, clay is introduced to the system 10 in the oil sands flow 12 and spills out of the logwasher 14 in the slurry 24 through the screen 26 to the first sand washer 34. A wash water containing the clay is pumped in the flow 70 to the flotation cell 22. A clay sludge with bitumen and sand is pumped as the under-flow 38 to the hydrocyclone system 40 which separates the clay, water and bitumen from the sand and sends the clay mixture to the thickener 44. Clay is output as the sludge flow 48.

Bitumen is introduced to the system 10 in the oil sands flow 12 and is skimmed out of the logwasher 14 by slit 18 and is prevented from spilling out through the screen 26 by the baffle 16. Oil is separated out by flotation and follows a flow 50 to the oil froth tank 52. Bitumen that was trapped in sand from the flotation cell 22 and the screen 26 is returned to the flotation cell 22 through the hydrocyclone system 40 and by the sand washers 34 and 60. (Sand washer 34 may be used without also using sand washer 60 in series.)

Temperatures of 180° F. to 200° F. are preferably maintained throughout the system 10.

Figure 2:
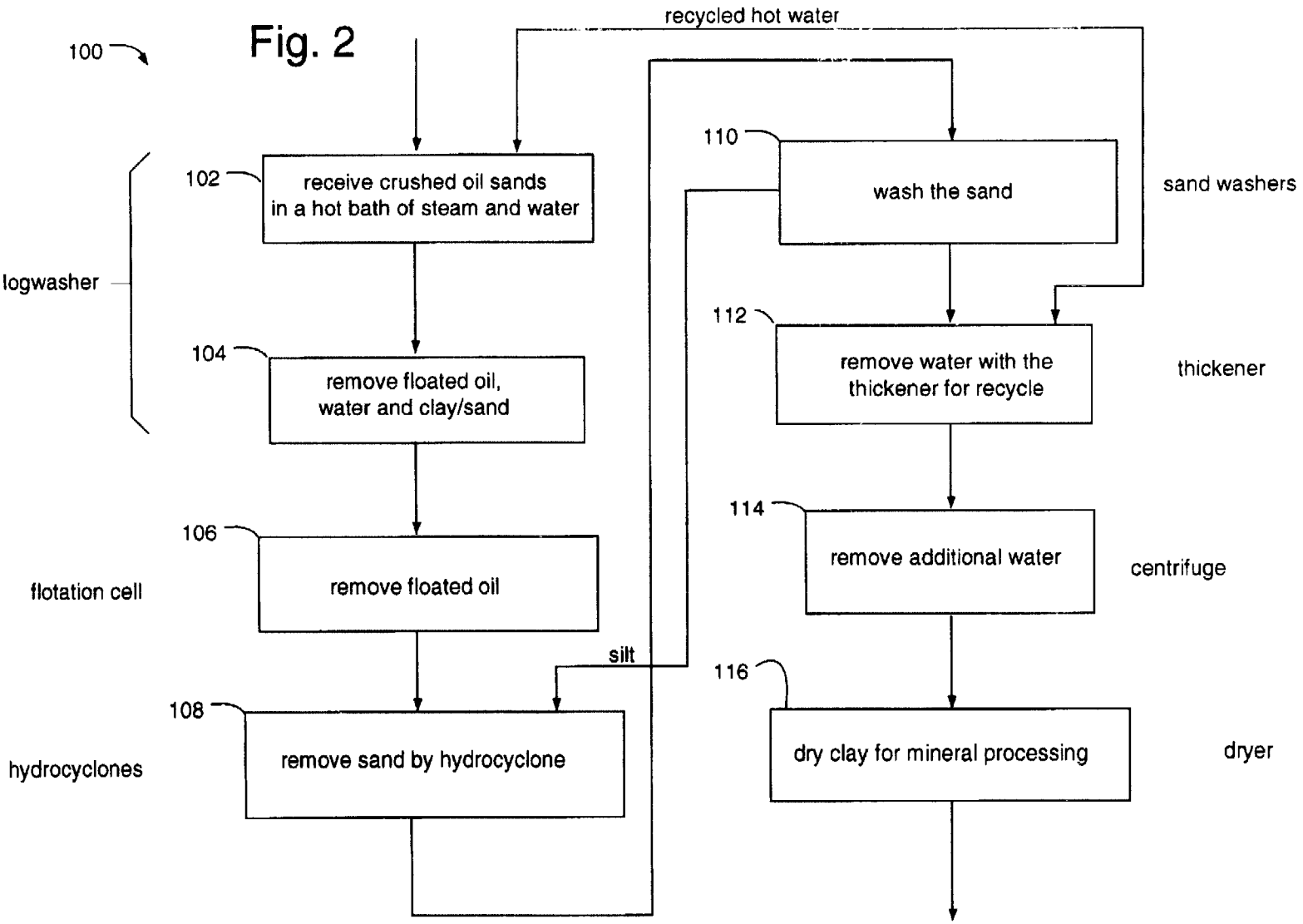
FIG. 2 is a block flow diagram for a method embodiment of the present invention for removing sand from a slurry of sand, clay, bitumen and water for separation by a hydrocyclone.

A method embodiment of the present invention, for removing sand from a slurry of sand, clay, bitumen and water for separation by a hydrocyclone, is referred to herein by the general reference numeral 100, and is illustrated in FIG. 2. A step 102 receives oil sand from a mine into a hot bath of steam and hot water in a logwasher, e.g., logwasher 14 (FIG. 1). In a step 104, the oil is floated from the logwasher in segregated layers into a flotation cell, e.g., cell 22 (FIG. 1). A step 106 floats the oil and removes it from the flotation cell. A step 108 removes sand from a slurry of sand, clay, bitumen and water from an under-flow of the flotation vessel in a hydrocyclone system.

Individual hydrocyclone units use a high-velocity spinning action for separating sand from a slurry by centrifugal force against a cylindrical screen. The centrifugal force drives the larger, heavier particles into the hydrocyclone underflow and the smaller, lighter particle into the overflow. Clay in the deposit is generally less than two microns in size, and the silt/sand is greater than ten microns.

In a step 110, the sand that is separated from the slurry by the hydrocyclone system is washed by sand washers before being discharged. A step 112 removes water in a thickener vessel for recycling. A step 114 takes out additional water with a centrifuge using solvents, or alternatively, using no solvents. A step 216 dries the clay in a dryer for mineral processing, e.g., smelting of the alumina in the clay for aluminum.

Figure 3:
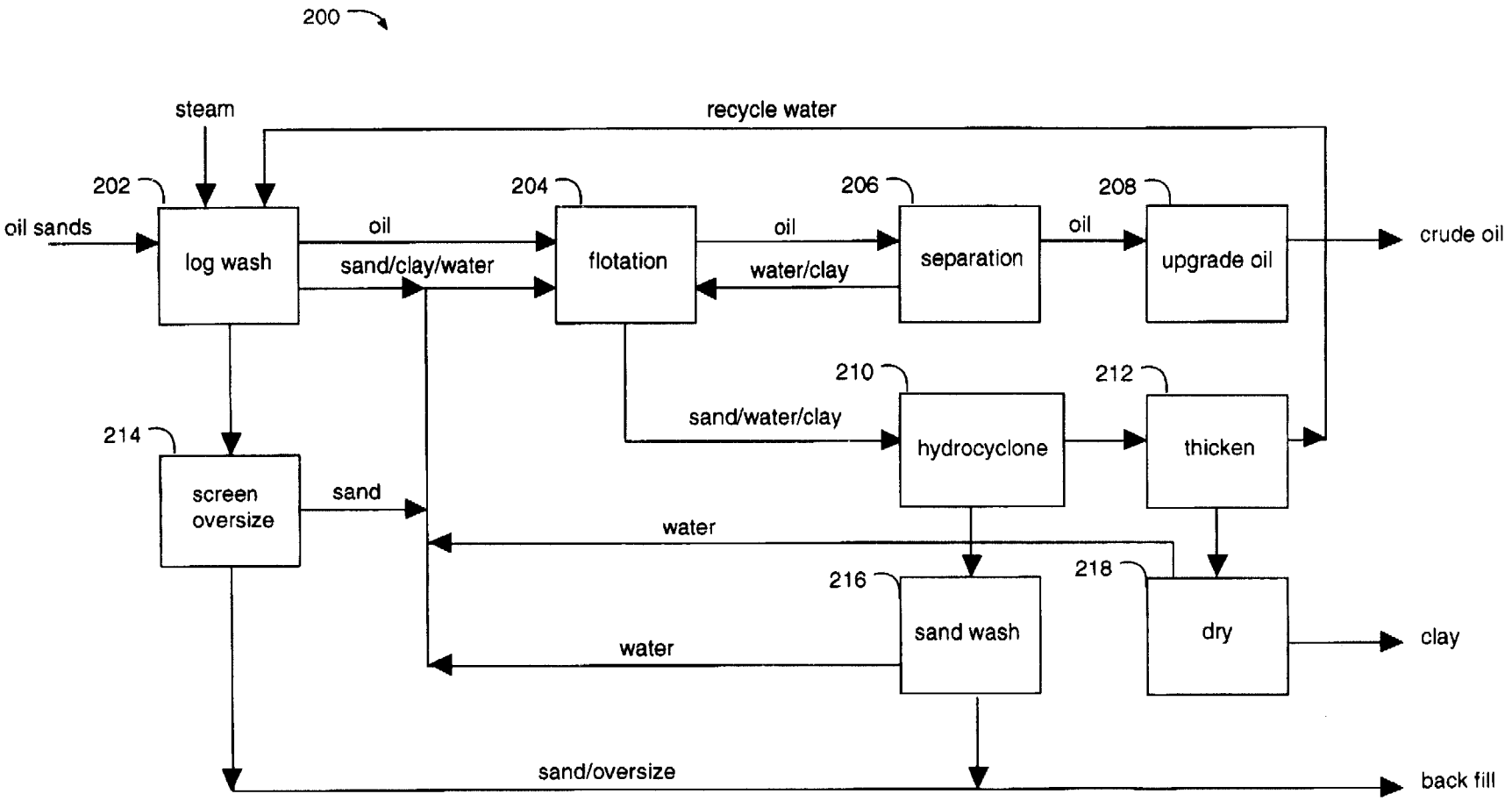
FIG. 3 is a block flow diagram for another method embodiment of the present invention for separating crude oil, clay for mineral processing and sand for mine backfill from oil sands.

FIG. 3 shows a process 200 for removing crude oil for refining, clay for mineral processing and sand for back fill into a mine from oil sands taken from the mine. A log washing step 202 receives the oil sands, steam and recycled hot water and separates them into oil, water/clay, and sand/rock. A step 204 receives the oil, clay, water and sand into a flotation cell and separates them into oil with water and clay. A step 206 separates water and clay from the oil and returns the separated water and clay to the flotation cell. A step 208 upgrades the separated oil for a pipeline for crude oil refining. A step 210 uses one or two hydrocyclones in series to separate out sand from a mixture of sand, water and clay received from the step 204. A step 212 uses a thickener to remove water from a mixture of clay and water received from the step 210. A step 214 screens out oversize from sand received from step 202. The oversize is contributed to sand for back fill to the mine. A step 216 uses one or two sand washers in series to clean sand received from the step 210 for back fill to the mine. The wash is added to the inputs to the step 204. A step 218 uses a centrifuge to dry the clay from the step 212 for mineral processing of the clay. Any water from the drying is returned to the step 204.

Although the present invention has been described in terms of the presently preferred embodiments, it is to be understood that the disclosure is not to be interpreted as limiting. Various alterations and modifications will no doubt become apparent to those skilled in the art after having read the above disclosure. Accordingly, it is intended that the appended claims be interpreted as covering all alterations and modifications as fall within the true spirit and scope of the invention.

What is claimed is:

1. A system for separating sand and clay from bitumen in oil sands, comprising:

a log washer including rotating paddles for mixing hot water, steam and oil sands into a slurry, and that is inclined along its longitudinal length with respect to the surface of said slurry within, wherein an oversize discharge is controlled to maintain a particular slurry-surface level;

a skimmer connected to the logwasher for drawing-off bitumen oils with sand, clay and water from the surface of said slurry with a horizontal slit and a baffle that divide a segregated flow out and a logwasher slurry;

a flotation vessel connected to receive said segregated flow from the skimmer and for separation by skimming off said bitumen oils from said sand, clay and water providing for an overflow of bitumen oils and an under-flow of sand, clay and water;

hydrocyclone separation means connected to receive said under-flow from the flotation vessel and for separating out sand from bitumen oils, clay and water and providing for an under-flow of sand connected the first sand washing means and an overflow of sand, clay and water;

a thickener vessel connected to receive said overflow from the hydrocyclone separation means and providing for a floating off a bitumen oils flow from a clay flow and a recycled water flow; and first sand washing means connected to receive a slurry of sand, clay and water with some still-unseparated bitumen oils from both the flotation vessel and a screening means and providing for a separating out of any remaining bitumen oils and returning a flow to the flotation vessel.

2. The system of claim 1, further comprising:

hydrocyclone separation means (40) connected to receive said under-flow (38) from the flotation vessel and for separating out sand from bitumen oils, clay and water and providing for an under-flow (36) of sand connected to the first sand washing means (34) and an overflow (42) of sand, clay and water; and a thickener vessel (44) connected to receive said overflow (42) from the hydrocyclone separation means and providing for a floating off a bitumen oils flow (45) from a clay flow (48) and a recycled water flow (46).

3. The system of claim 1, further comprising:

second sand washing means (60) connected to receive a slurry (66) of sand, clay and water with some still-unseparated bitumen oils from the first sand washing means (34) and for separating out any remaining bitumen oils and returning them in a flow (68) to the flotation vessel (22) via the first sand washing means (34).

4. The system of claim 1, further comprising:

inclination means connected to the logwasher for varying the angle of the longitudinal length of the logwasher with respect to the surface of said slurry within.

5. The system of claim 1, wherein:

said screening means is connected to the logwasher for separating out rock from a fraction of said slurry not drawn-off by the skimmer.

* * * * *